US008161846B2

(12) United States Patent
Drzewiecki

(10) Patent No.: US 8,161,846 B2
(45) Date of Patent: Apr. 24, 2012

(54) APPARATUS AND METHODS FOR SPINNING A PIPE

(75) Inventor: Lopek Drzewiecki, Edmonton (CA)

(73) Assignee: National Oilwell Varco, L.P., Houston, TX (US)

( * ) Notice: Subject to any disclaimer, the term of this patent is extended or adjusted under 35 U.S.C. 154(b) by 287 days.

(21) Appl. No.: 12/480,192

(22) Filed: Jun. 8, 2009

(65) Prior Publication Data

US 2009/0301262 A1 Dec. 10, 2009

Related U.S. Application Data

(60) Provisional application No. 61/059,848, filed on Jun. 9, 2008.

(51) Int. Cl.
*B25B 13/50* (2006.01)

(52) U.S. Cl. ..... 81/57.33; 81/57.18; 81/57.2

(58) Field of Classification Search ..... 81/57.15, 81/57.17, 57.19, 57.18, 57.2, 57.33, 57.34, 81/57.43, 57.44
See application file for complete search history.

(56) References Cited

U.S. PATENT DOCUMENTS

| | | | | |
|---|---|---|---|---|
| 1,760,167 | A | 5/1930 | Palmer | |
| 1,925,970 | A | 9/1933 | Pennington | |
| 2,523,159 | A | 9/1950 | Stone | |
| 2,746,329 | A | 5/1956 | Paget | |
| 2,784,626 | A | 3/1957 | Paget | |
| 2,928,301 | A | 3/1960 | Beeman et al. | |
| 3,799,010 | A | 3/1974 | Guier | |
| 3,906,820 | A | 9/1975 | Hauk | |
| 4,079,640 | A | 3/1978 | Golden | |
| 4,099,429 | A | 7/1978 | Hauk | |
| 4,212,212 | A | 7/1980 | Chandler et al. | |
| 4,324,157 | A | 4/1982 | Soutsos | |
| 4,471,674 | A | 9/1984 | Doss | |
| 4,494,424 | A | 1/1985 | Bates | |
| 4,512,216 | A | 4/1985 | Callegari, Sr. et al. | |
| 4,604,922 | A | 8/1986 | Soutsos | |
| 4,694,712 | A | 9/1987 | Doss | |
| 4,843,924 | A | 7/1989 | Hauk | |
| 4,895,056 | A | 1/1990 | Schulze-Beckinghausen | |
| 5,054,550 | A | 10/1991 | Hodge | |
| 6,910,402 | B2 * | 6/2005 | Drzewiecki | 81/57.17 |

(Continued)

FOREIGN PATENT DOCUMENTS

NL 7304226 A 10/1973

OTHER PUBLICATIONS

Office Action for Norwegian Application No. 20043346, Aug. 22, 2010 (1 p.).

(Continued)

*Primary Examiner* — Debra S Meislin
(74) *Attorney, Agent, or Firm* — Conley Rose, P.C.

(57) ABSTRACT

Apparatus and methods for rotating or spinning a tubular. In some embodiments, the apparatus, referred to herein as a pipe spinner, includes a body, an arm pivotally coupled to the body, and an actuator coupled to the arm. The arm has a cam roller coupled thereto. The actuator is operable to pivot the arm relative to the body between an open position and a closed position. In the closed position, the cam roller engages the tubular. In the open position, the cam roller is disengaged from the tubular.

15 Claims, 4 Drawing Sheets

U.S. PATENT DOCUMENTS

2009/0277626 A1* 11/2009 Littlely ..... 81/57.34

OTHER PUBLICATIONS

Office Action for Norwegian Application No. 20043346, Jun. 24, 2007 (2 p.).
Examination Report for British Application No. GB0416961.1, Dec. 21, 2005 (2 p.).
Office Action for Canadian Application No. 2,475,892, Dec. 19, 2006 (3 p.).
Office Action for U.S. Appl. No. 10/640,531, Sep. 24, 2004 (10 p.).
Search Report for British Application No. GB0416961.1, Sep. 13, 2004 (3 p.).

* cited by examiner

APPARATUS AND METHODS FOR SPINNING A PIPE

CROSS-REFERENCE TO RELATED APPLICATIONS

This application claims benefit of U.S. Provisional Application Ser. No. 61/059,848 filed on Jun. 9, 2008, and entitled "Apparatus and Methods for Spinning a Pipe," which is hereby incorporated herein by reference in its entirety for all purposes.

STATEMENT REGARDING FEDERALLY SPONSORED RESEARCH OR DEVELOPMENT

Not applicable.

BACKGROUND

The present disclosure relates to apparatus and methods for rotating a tubular member, such as a drill pipe. More particularly, the present disclosure relates to apparatus and methods for spinning a drill pipe during connection and disconnection of the drill pipe in a drill string.

In rotary drilling applications, a tubular drill string is formed from a series of connected lengths of drill pipe. The individual lengths of drill pipe are joined end-to-end by threaded connections. During the drilling and completion of a well, the drill string must occasionally be pulled from the well and reinstalled. The process of pulling or installing the drill string is referred to as "tripping." During tripping, the threaded connections between the lengths of drill pipe are connected and disconnected, as needed. The connecting and disconnecting of adjacent sections of drill pipe (referred to as making or breaking the connection, respectively) involves applying torque to the connection and rotating one of the pipes to fully engage or disengage the mating threads.

In modern wells, a drill string may be thousands of feet long and typically is formed from individual thirty-foot sections of drill pipe. Even if only every third connection is broken, as is common, hundreds of connections have to be made and broken during tripping. Thus, it can be seen that the tipping process is one of the most time consuming and labor intensive operations performed on a drilling rig.

Currently, there are a number of devices that seek to speed tripping operations by automating or mechanizing the process of making and breaking a threaded pipe connection. These devices include tools such as power tongs, iron roughnecks, and pipe spinners. Many of these devices are complex pieces of machinery that require two or more people to operate and require multiple steps, either automated or manual, to perform the desired operations. Additionally, many of these devices grip the pipe with teeth that can damage the drill pipe and often cannot be adjusted to different pipe diameters without first replacing certain pieces, or performing complex adjustment procedures.

Thus, the embodiments described herein are directed to apparatus and methods for gripping and spinning a pipe for making or breaking a connection that seek to overcome these or various other limitations of the prior art.

SUMMARY OF THE PREFERRED EMBODIMENTS

Apparatus for spinning a pipe, referred to herein as a pipe spinner, are disclosed. In some embodiments, the pipe spinner includes a body, an arm pivotally coupled to the body, and an actuator coupled to the arm. The arm has a cam roller coupled thereto. The actuator is operable to pivot the arm relative to the body between an open position and a closed position. In the closed position, the cam roller engages the tubular. In the open position, the cam roller is disengaged from the tubular.

In other embodiments, the pipe spinner includes a body with a drive assembly coupled thereto, a tensioning member pivotally coupled to the body, a flexible belt coupled between the tensioning member and the drive assembly, and an actuator coupled between the body and the tensioning member. The actuator is operable to displace the tensioning member between a first position and a second position. When the tensioning member is displaced toward the second position, the tensioning member increases a tension load to the flexible belt. When the tensioning member is displaces toward the first position, the tensioning member reduces the tension load to the flexible belt.

In still other embodiments, the pipe spinner includes a body having a longitudinal centerline, a first arm and a second arm each pivotally coupled to the body, a linkage system coupled between the first and second arms, and a first actuator and a second actuator each coupled to the body. The first and second arms are disposed on opposing sides of the longitudinal centerline. The first actuator is operable to pivot the first arm relative to the body, and the second actuator is operable to pivot the second arm relative to the body. The linkage system is configured such that movement of the second arm mirrors of movement of the first arm, and movement of the first arm mirrors movement of the second arm.

Some methods for spinning a pipe include receiving the pipe between two arms, pivoting the arms to engage and lock the pipe between the arms and a flexible belt, displacing a tensioning member to tighten the flexible belt about the pipe, and rotating the flexible belt, whereby the pipe rotates. The methods may further include displacing the tensioning member after pivoting the arms.

Thus, the disclosed embodiments comprise a combination of features and advantages that enable substantial enhancement of pipe spinners and their associated methods. These and various other characteristics and advantages of the invention will be readily apparent to those skilled in the art upon reading the following detailed description of the preferred embodiments of the invention and by referring to the accompanying drawings

BRIEF DESCRIPTION OF THE DRAWINGS

For a more detailed understanding of the present disclosure, reference is made to the accompanying figures, wherein.

DETAILED DESCRIPTION OF THE DISCLOSED EMBODIMENTS

Figure 1:
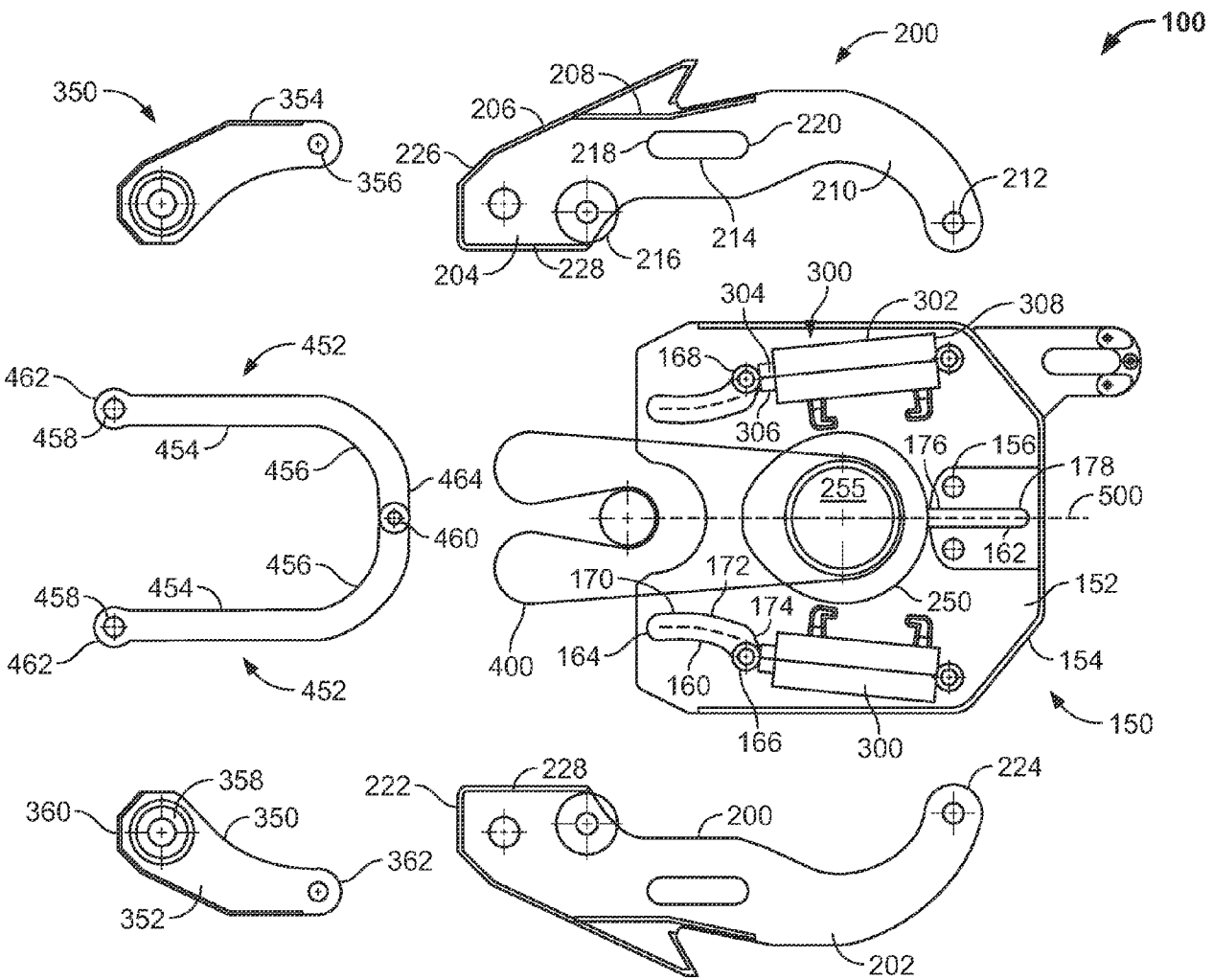
FIG. 1 is an exploded, cross-sectional view of an embodiment of a pipe spinner in accordance with the principles disclosed herein.

The embodiments of the disclosure relate to apparatus and methods for rotating a tubular member, such as a pipe. The disclosure is susceptible to embodiments of different forms. There are shown in the drawings, and herein will be described in detail, specific embodiments with the understanding that the present disclosure is to be considered an exemplification of the principles of the invention, and is not intended to limit the invention to that illustrated and described herein. In particular, various embodiments provide a number of different spinner configurations. Reference is made to the application of the concepts of the present disclosure to rotating drill pipe, but the use of the concepts of the present disclosure is not limited to these applications, and can be used for any other applications including the rotation of cylindrical bodies and in particular to the manipulation of other members having threaded connections. It is to be fully recognized that the different teachings of the embodiments discussed below may be employed separately or in any suitable combination to produce desired results.

Certain terms are used throughout the following description and claims to refer to particular features or components. As one skilled in the art will appreciate, different persons may refer to the same feature or component by different names. This document does not intend to distinguish between components or features that differ in name but not function or structure. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus are to be interpreted to mean "including, but not limited to . . . ." Also, the term "couple" or "couples" is intended to mean either an indirect or direct connection. Thus, if a first device couples to a second device, that connection may be through a direct connection, or through an indirect connection via other devices and connections.

Referring now to FIG. 1, a pipe spinner assembly 100 includes a body 150, two pivoting arms 200, a motor 250, two linear actuators 300, two tensioning members 350, a flexible belt 400, and two equalizer linkages 450. The structure of spinner assembly 100 is substantially mirrored about its longitudinal centerline 500.

Figure 2:
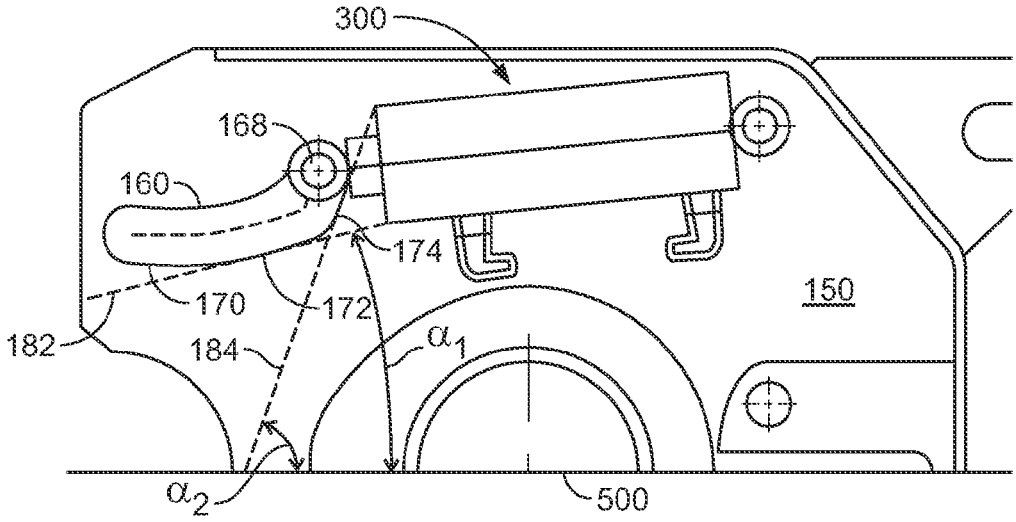
FIG. 2 is an enlarged view of a linear actuator coupled to the body of FIG. 1, illustrating the shape of a body slot.
Figure 3:
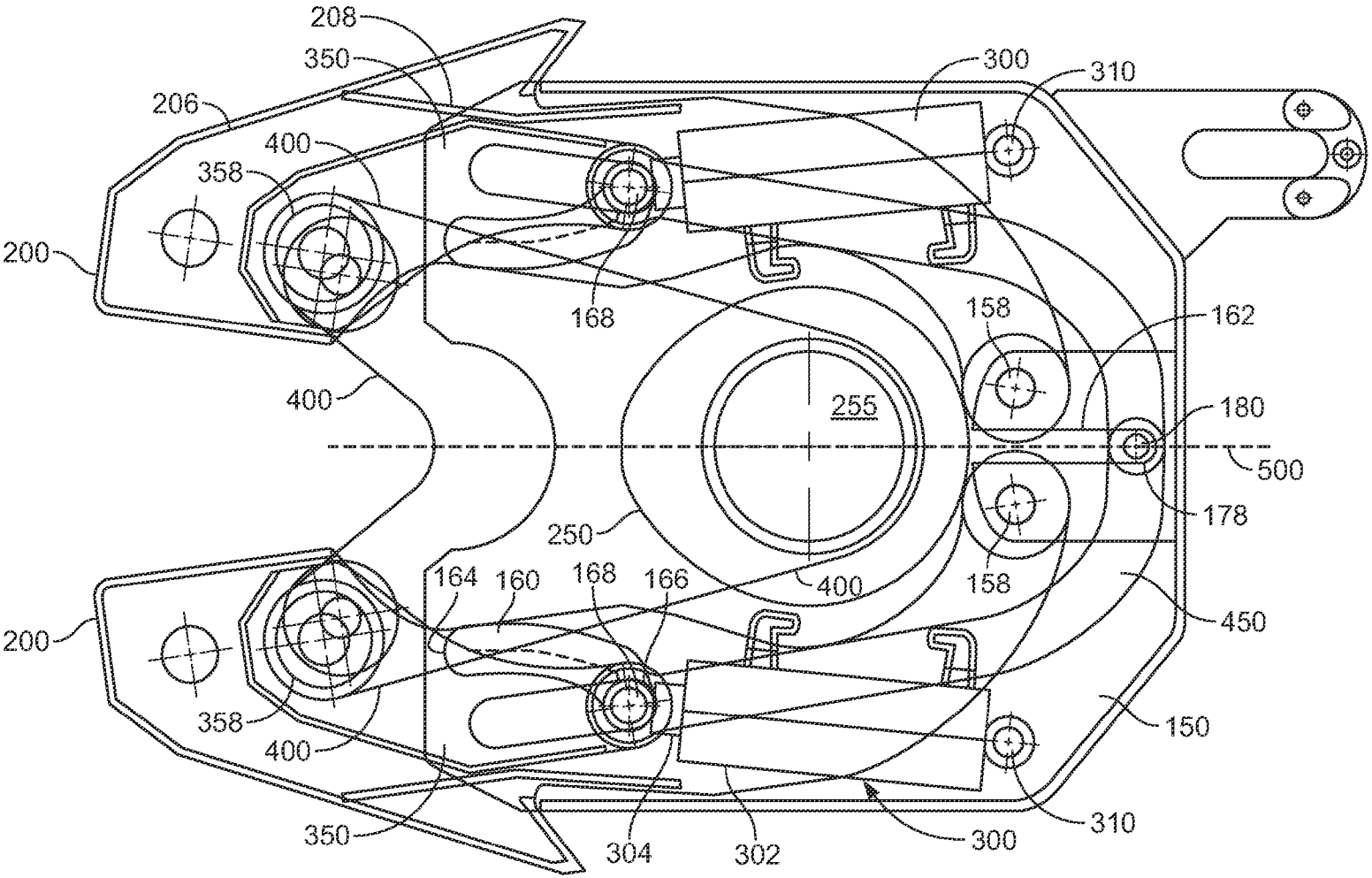
FIG. 3 is an assembled, cross-sectional view of the pipe spinner of FIG. 1 in an open configuration.

Body 150 includes a flat, generally rectangular base 152 with a wall 154 extending normally from base 152 along a portion of its periphery. Base 152 includes two body slots 160, two throughbores 156, and an equalizer shaft slot 162. Throughbores 156 are positioned on opposite sides of equalizer shaft slot 162 and centerline 500 and are each configured to receive a pivot pin 158 (FIG. 3). Each body slot 160 has a first or forward end 164 and a second or rearward end 166. Each body slot 160 is configured to slidingly receive a connecting pin 168, which moves within body slot 160 between forward end 164 and rearward end 166. In this embodiment, each body slot 160 includes a straight portion 170 and two angled portions 172, 174. Straight portion 170 extends from forward end 164 to angled portion 172 and is substantially parallel to longitudinal centerline 500. Angled portion 174 extends from rearward end 166 to angled portion 172. In other words, angled portion 172 is disposed between straight portion 170 and angled portion 174. In some embodiments, either or both of angled portions 172, 174 may be linear or straight, while in other embodiments, either portion 172, 174 may be curved. Referring briefly to FIG. 2, which illustrates an enlarged portion of body 150 with a linear actuator 300 coupled thereto, angled portion 172 is oriented at an acute angle $\alpha_1$ measured between centerline 500 and a line 182 tangent to its surface. Angled portion 174 is oriented at an acute angle $\alpha_2$ measured between centerline 500 and a line 184 tangent to its surface. In this embodiment, angle $\alpha_2$ is greater than angle $\alpha_1$.

Referring again to FIG. 1, equalizer shaft slot 162 extends linearly along longitudinal centerline 500, and has a first or forward end 176 and a second or rearward end 178. Equalizer shaft slot 162 is configured to slidingly receive an equalizer shaft 180 (FIG. 3), which moves within equalizer shaft slot 162 between forward end 176 and rearward end 178. Body 150 also preferably includes a top (not shown) that has similar features to base 152. The top portion is mounted to base 152 by connecting the wall of the top portion to wall 154 of base 152, such that body 150 substantially encloses motor 250, linear actuators 300, and portions of pivoting arms 200 and tensioning members 350 coupled thereto.

Each pivoting arm 200 includes a substantially flat base 202 extending between a first or forward end 222 and a second or rearward end 224. Base 202 includes an enclosed portion 204 and a curved portion 210. Enclosed portion 204 generally extends from first end 222 to curved portion 210, and curved portion 210 extends from rearward end 224 to enclosed portion 204. Enclosed portion 204 is surrounded and defined by all external guide wall 206 that extends normally from the periphery of base 202. External glide wall 206 includes an outer portion 226 and an inner portion 228 extending therefrom. Pivoting arm 200 further includes a cam roller 216 rotatably coupled to base 202 within enclosed portion 204, all internal guide wall 208 extending normally from base 202 within enclosed portion 204, a throughbore 212 extending through rearward end 224, and an arm slot 214 formed in base 202 generally at the intersection of enclosed portion 204 and curved portion 210. Throughbore 212 is configured to receive a pivot pin 158 (FIG. 3). Arm slot 214 has a first or forward end 218 and a second rearward end 220. Arm slot 214 is configured to slidingly receive a connecting pin 168, which moves within arm slot 214 between forward end 218 and rearward end 220. In this embodiment, arm slot 214 is substantially linear. Each pivoting arm 120 preferably includes a top portion (not shown) that has similar features to base 202. The top portion is mounted to base 202 by connecting the external and internal guide walls of the top portion to external guide wall 206 and internal guide wall 208, respectively, of base 202, such that pivoting arm 200 substantially encloses pipe cam roller 216.

Each pivoting arm 200 couples to body 150 by aligning throughbore 212 of rearward end 224 of arm 200 with throughbore 156 of body 150 and coaxially inserting a pivot pin 158 (FIG. 3) through the aligned bores 156, 212. Further, a connecting pin 168 is inserted through arm slot 214 and body slot 160, such that connecting pin 168 is slideable within both slots 160, 214. Once assembled, as shown in FIG. 3, displacement of connecting pin 168 within and along angled portions 172, 174 of body slot 160 causes arm 200 to pivot about pin 158 relative to body 150. For example, when connecting pin 168 slides along angled portions 174, 172 of body slot 160 from rearward end 166 toward forward end 164, pivoting arm 200 closes, meaning arm 200 pivots inward or toward longitudinal centerline 500. Alternatively, when connecting pins 168 slides along angled portions 172, 174 of body slot 160 toward rearward end 166, pivoting arm 200 opens, meaning arm 200 pivots outward or away from longitudinal centerline 500.

Referring again to FIG. 1, each tensioning member 350 includes a substantially flat base 352 having a first or forward end 360 and a second or rearward end 362. A guide wall 354 extends normally from a portion of its periphery generally distal centerline 500. Base 352 further includes a throughbore 356 extending through rearward end 362. Throughbore 356 is configured to receive a connecting pin 168. Tensioning member 350 further includes an idler roller 358 rotatably coupled to base 352. Each tensioning member 350 preferably includes a top portion (not shown) that has similar features to base 352. The top portion is mounted to base 352 by connecting the guide wall of the top portion with guide wall 354 of base 352, such that tensioning member 350 substantially encloses idler roller 358.

Each tensioning member 350 is coupled to one of pivoting arms 200 by positioning tensioning member 350 such that forward end 360 is disposed between internal guide wall 208, outer portion 226 of external guide wall 206, and inner portion 228 of external guide wall 206. Further, throughbore 356 of tensioning member 350 is aligned with connecting pin 168 and connecting pin 168 is inserted coaxially therethrough. Once assembled, as shown in FIG. 3, tensioning member 350 may pivot about connecting pin 168 relative to arm 200. Pivoting of tensioning member 350 relative to arm 200 is limited by contact between guide wall 354 of tensioning member 350 and guide walls 206, 208 of arm 200. For example, when connecting pin 168 slides within angled portions 174, 172 of body slot 160 from rearward end 166 toward forward end 164 and arm 200 closes, as described above, tensioning member 350 also pivots toward longitudinal centerline 500 by virtue of its coupling to connecting pin 168 via throughbore 356 and its confinement between guide walls 206, 208 of arm 200. Alternatively, when connecting pin 168 slides within angled portions 172, 174 of body slot 160 toward rearward end 166 and arm 200 opens, as described above, tensioning member 350 also pivots away from longitudinal centerline 500 by virtue of its coupling to connecting pin 168 via throughbore 356 and its confinement between guide walls 206, 208 of arm 200.

Referring again to FIG. 1, each linear actuator 300 includes a barrel 302 and a rod 304 disposed within barrel 302. Further, linear actuator 300 is operable to axially extend rod 304 from barrel 302 and to axially retract rod 304 within barrel 302. In this embodiment, linear actuator 300 is a hydraulic cylinder. Rod 304 includes a forward end 306 that receives connecting pin 168. Barrel 302 includes a rearward end 308 (opposite end 306 of rod 304) that is pivotally coupled to body 150 by a pivot pin 310 (FIG. 3).

When linear actuator 300 is actuated to extend rod 304, rod 304 displaces connecting pin 168 along body slot 160 from rearward end 166 toward forward end 164. Due to the angular nature of portions 174, 172 of body slot 160, linear actuator 300 pivots about pivot pin 310 generally toward longitudinal centerline 500 as connecting pin 168 slides along angled portions 174, 172. Conversely, when linear actuator 300 is actuated to retract rod 304, rod 304 displaces connecting pin 168 along angled portions 172, 174 of body slot 160 toward rearward end 166. Due to the angular nature of portions 172, 174, linear actuator 300 pivots about pivot pin 310 generally away from longitudinal centerline 500 as connecting pin 168 slides along angled portions 172, 174. Further, due to the coupling of connecting pin 168 with pivoting arm 200 and tensioning member 350, arm 200 and tensioning member 350 pivot in response to movement of connecting pin 168 along angled portions 172, 174 of body slot 160, as described above.

Each equalizer linkage 450 includes two substantially identical J-shaped rigid links 452. Each link 452 includes a forward end 462, a rearward end 464, a straight portion 454, and a curved portion 456. Straight portion 454 extends from forward end 462 to curved portion 456, and curved portion 456 extends from rearward end 464 to straight portion 454. Forward end 462 of each straight portion 454 includes a throughbore 458 that receives connecting pin 168. Further, rearward end 464 of each curved portion includes a throughbore 460 that receives equalizer shaft 180 (FIG. 3).

Each equalizer linkage 450 is assembled by axially aligning throughbores 460 of links 452 and inserting equalizer shaft 180 (FIG. 3) therethrough, such that one linkage 450 is coupled to shaft 180 proximate base 152 of body 150 and the other linkage 450 is coupled to shaft 180 proximate the top of body 150. Each equalizer linkage 450 is then coupled to body 150 by inserting one end of equalizer shaft 180 into equalizer shaft slot 162 in base 152 of body 150 and the other end of equalizer shaft 180 into the equalizer shaft slot in the top of body 150. In other words, linkages 450 are both disposed between base 152 and the top of body 150, rearward ends 464 of links 452 are pivotally coupled together with shaft 180 via throughbores 460, and rearward ends 464 of links 452 are coupled to body 150 with shaft 180 via equalizer shaft slot 162 in base 152 and the equalizer shaft slot in the top. Forward end 462 of each link 452 is coupled to body 150 with one of connecting pins 168.

Once assembled, as shown in FIG. 3, each equalizer linkages 450 are translatable with connecting pins 168 relative to body 150 as connecting pins 168 slide within body slots 160 of body 150, as described above. This translational movement is enabled by equalizer shaft 180, which is free to slide linearly within equalizer shaft slot 162 in base 152 and the equalizer shaft slot in the top of body 150. For example, when connecting pins 168 slide within body slots 160 from rearward ends 166 toward forward ends 164, equalizer shaft 180, with equalizer linkages 450 coupled thereto, translates within equalizer shaft slot 162 from rearward end 178 toward forward end 176. Conversely, when connecting pins 168 slide within body slots 160 from forward ends 164 toward rearward ends 166, equalizer shaft 180 translates within equalizer shaft slot 162 from frontward end 176 toward rearward end 178. Further, each link 452 is pivotable about equalizer shaft 180 and its respective connecting pin 168 as the connecting pin 168, with link 452 coupled thereto, slides within angled portions 172, 174 of body slot 160.

Because each half of one equalizer linkage 450, defined relative to longitudinal centerline 500, is a mirror image of the other and because links 452 are rigid, equalizer linkages 450 ensure that any motion of one pivoting arm 200 relative to body 150 is mirrored by the other pivoting arm 200. For example, when one arm 200 opens to a degree, the other arm 200 also opens to substantially the same degree. Furthermore, by utilizing two equalizer linkages 450 coupled to equalizer shaft 180 some distance apart, any moments imparted to arms 200 by equalizer linkages 450 is minimized.

Referring again to FIG. 1, motor 250 is coupled to body 150 such that motor 250 does not move translationally relative to body 150. Motor 250 is configured to drive a belt pulley 255 around which flexible belt 400 extends, and is preferably a hydraulic or air motor. Belt 400 is preferably constructed from a flexible, durable, and strong material such as Kevlar®, or some other durable, high strength, woven, composite material. In addition to belt pulley 255, belt 400 also extends around idler rollers 358 of tensioning members 350, as shown in FIG. 3.

Figure 4:
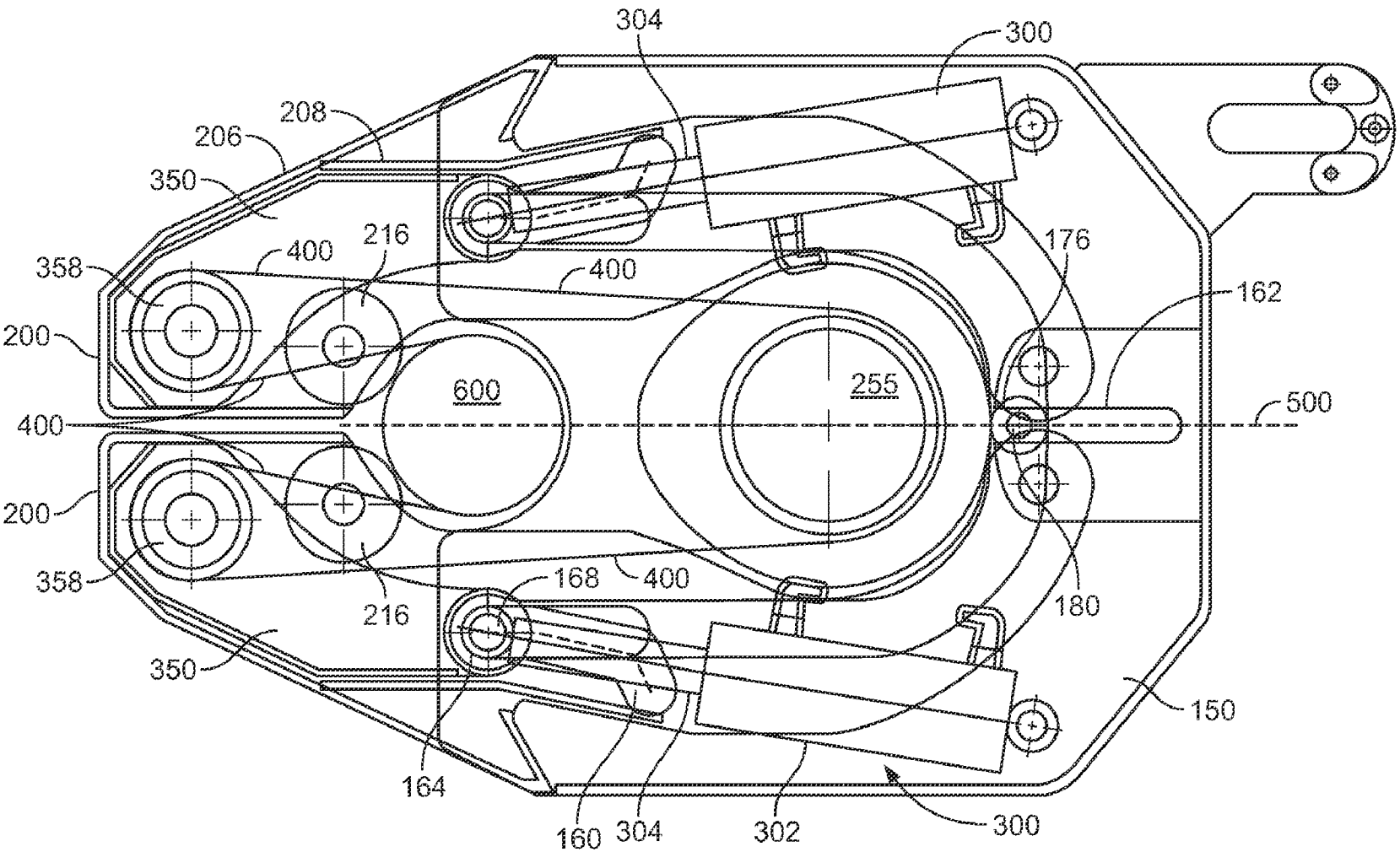
FIG. 4 is an assembled, cross-sectional view of the pipe spinner of FIG. 1 in a closed configuration.

When pivoting arms 200 open, as shown in FIG. 3, a pipe may be received between arms 200 and engaged by belt 400. When pivoting arms 200 subsequently close, as shown in FIG. 4, belt 160 extends around pipe 600, gripping pipe 600 without damaging its outer surface and locking pipe 600 within pipe spinner 100 in engagement with belt 400. Further, when linear actuators 300 are actuated to extend rods 304, tensioning members 350 with idler rollers 358 coupled thereto move generally away from motor 250, thereby stretching and tensioning belt 400 and increasing the frictional engagement between belt 400 and pipe 600 to enable rotation of pipe 600. Conversely, when linear actuators 300 are actuated to retract rods 304, tensioning members 350 with idler rollers 358 coupled thereto move generally towards motor 250, thereby relaxing belt 400 and decreasing the frictional engagement between belt 400 and pipe 600.

Returning to FIG. 3, pipe spinner 100 is shown in the fully open position. Linear actuators 300 have been actuated to fully retract rods 304 within barrels 302. Due to the coupling of rods 304 with connecting pins 168, connecting pins 168 are displaced to rearward ends 166 of body slots 160 in body 150. Equalizer linkages 450 are translated such that equalizer shaft 180 is at rearward end 178 of equalizer shaft slot 162. Pivoting arms 200, with tensioning members 350 disposed therein, are open. Belt 400 is fully relaxed and ready to receive pipe 600.

Referring next to FIG. 4, pipe spinner 100 is shown in the fully closed position. Linear actuators 300 have been actuated to fully extend rods 304 from barrels 302. Due to the coupling of rods 304 with connecting pins 168, connecting pins 168 are displaced to forward ends 164 of body slots 160 in body 150. Equalizer linkages 450 are translated such that equalizer shaft 180 is at forward end 176 of equalizer shaft slot 162. Pivoting arms 200, with tensioning members 350 disposed therein, are closed. Tensioning members 350 are extended relative to pivoting arms 200 and body 150. Pipe cam rollers 216 engage pipe 600 to hold pipe 600 against belt 400. Belt 400 is wrapped around pipe 600 and in tension, ready to spin pipe 600. In this closed position, motor 250 rotates pulley 255, which transfers motion through belt 400 to pipe 600.

In order for pipe spinner 100 to move from the open position shown in FIG. 3 to the closed position shown in FIG. 4, pipe 600 is positioned between arms 200 against belt 400, and linear actuators 300 are actuated. As actuators 300 begin to extend rods 304 from barrels 302, rods 304 displace connecting pins 168 along body slots 160 away from rearwards ends 166 toward forwards ends 164. As connecting pins 168 slide along angled portions 174 of slots 160, linear actuators 300 pivot inward relative to body 150 about pivot pins 310. Due to the angular nature of portions 174 of body slots 160, arms 200 pivot rapidly inward relative to body 150 about pins 158 as connecting pins 168 displace along arm slots 214. Moreover, as arms 200 pivot inward, or close, tensioning members 350 also pivot inward, constrained by guide walls 206, 208 of arms 200. As arms 200 and tensioning members 350 pivot inward, the extension of rods 304 pushes connecting pins 168 and therefore tensioning members 350 generally away from motor 250, thereby beginning to tension belt 400.

Once connecting pins 168 reach angled portions 172 of body slots 160, the pivoting motion of arms 200, and tensioning members 350 disposed therein, toward the closed position continues but at a slower rate due to the smaller angular offset of portions 172 in comparison to that of portions 174. However, the continued extension of rods 304 and associated travel of connecting pins 168 results in the continued movement of tensioning members 350 generally away from motor 250, thereby continuing to increase the tension on belt 400.

When connecting pins 168 reach straight portions 170 of body slots 160, arm slots 214 align with straight portions 170 and arms 200 cease to pivot relative to body 150. Arms 200 are now fully closed, and pipe cam rollers 216 engage pipe 600 to hold it in place against belt 400. Also, tensioning members 350 cease to pivot inward, but continue to extend relative to arms 200, body 150, and motor 250. From this point, further extension of rods 304 of linear actuators 300 translates connecting pins 168 through straight portions 170 of body slots 160 toward forward ends 218 of body slots 160. Tensioning members 350 continue to be displace with connecting pins 168, thereby continuing to stretch and tension belt 400. This translational movement of tensioning members 350 enables pipe spinner 100 to remove any remaining slack in belt 400.

Once connecting pins 168 reach forward ends 164 of body slots 160, tensioning members 350 cease to translate, belt 400 is fully tensioned, and arms 200 are essentially locked in place. Forces on arms 200 from tensioning of belt 400 and operation of pipe spinner 100 will tend to pivot arms 200 toward the open position. However, these forces will be resisted by connecting pins 168 retained within straight portions 170 of body slots 160 and held in position by rods 304 of linear actuators 300.

After pipe spinner 100 is in the closed position shown in FIG. 4, motor 250 can be actuated so as to rotate pulley 255, which moves belt 400 and in turn rotates pipe 600. Body slots 160 and arm slots 214 constrain connecting pins 168 to operate as a safety lock preventing arms 200 from opening as pipe 600 is pushed by belt 400 against pipe cam rollers 216. Once arms 200 are locked in the fully closed position, they may only open after rods 304, with connecting pins 168 coupled thereto, are retracted by linear actuators 300.

Returning pipe spinner 100 to the open position of FIG. 3 from the closed position of FIG. 4, which allows the release of pipe 600, operates in the opposite sequence. Linear actuators 300 are actuated to retract rods 304. As rods 304 begin to retract, connecting pins 168 translate along straight portions 170 of body slots 160. Although arms 200 do not yet pivot, and thus remain in the closed position, tensioning members 350 translate within arms 200 with connecting pins 168 and belt 400 begins to relax. Further retraction of rods 304 displaces connection pins 168 along angled portions 172 of body slots 160, causing arms 200 to pivot outward relative to body 150 and begin to open. As arms 200 begin to open, tensioning members 350 also pivot outward, thereby farther relieving the tension load to belt 400. Still further retraction of rods 304 displaces connections pins 168 along angled portions 174 of body slots 160, causing arms 200 to continue pivoting outward, but more quickly, again due to the increased angular offset of portions 174 relative to that of portions 172. When connecting pins 168 reach rearwards ends 166 of body slots 160, arms 200 are fully open, and pipe 600 is released. Pipe spinner 100 is then ready for a new operation.

The above-described actuation sequence of pipe spinner 100, which encloses and locks pipe 600 within pipe spinner 100 before fully tensioning belt 400, is unique at least because it allows pipe spinner 100 to receive and rotate a wide range of pipe sizes with a single belt length and without any additional adjustment by an operator. Moreover, the arrangement of body slots 160 and arm slots 214 provide a self-locking feature that eliminates the need for a separately engaging lock feature and its associated complexities typically included in conventional belt-type pipe spinners.

The embodiments set forth herein are merely illustrative and do not limit the scope of the disclosure or the details therein. It will be appreciated that many other modifications and improvements to the disclosure herein may be made without departing from the scope of the invention or the inventive concepts herein disclosed. Because many varying and different embodiments may be made within the scope of the inventive concept herein taught, including equivalent structures or materials hereafter thought of, and because many modifications may be made in the embodiments herein detailed in accordance with the descriptive requirements of the law, it is to be understood that the details herein are to be interpreted as illustrative and not in a limiting sense.

What is claimed is:

1. A device for rotating a tubular comprising:

a body;

an arm pivotally coupled to said body, said arm having a cam roller coupled thereto;

an actuator coupled to said arm, said actuator operable to pivot said arm relative to said body between an open position and a closed position;

wherein, in the closed position, the cam roller engages the tubular, and wherein, in the open position, the cam roller is disengaged from the tubular;

wherein said arm comprises a slot formed therein, the slot having a forward end and a rearward end, and wherein said actuator is coupled to said arm by a pin slideably disposed within the slot;

wherein said actuator is operable to slide the pin within the slot toward the forward end, whereby said arm pivots toward the closed position, and toward the rearward end, whereby said arm pivots toward the open position;

a tensioning member pivotally coupled to the pin.

2. The device of claim 1, wherein the slot is linear.

3. The device of claim 1, wherein said tensioning member comprises a throughbore at an end; and wherein the pin extends into the throughbore to couple said actuator to said tensioning member.

4. The device of claim 1, wherein, when said arm pivots toward the closed position, said arm is configured to engage said tensioning member, whereby said tensioning member pivots relative to said body, whereby said tensioning member increases a tension load to a flexible belt engaging the tubular, whereby the flexible belt urges the tubular toward the cam roller; and wherein, when said arm pivots toward the open position, said arm is configured to engage said tensioning member, whereby said tensioning member pivots relative to said body, whereby said tensioning member decreases the tension load to a flexible belt.

5. The device of claim 4, wherein said arm further comprises a base wherein the slot is formed, a first wall extending substantially normally from the base, and a second wall extending substantially normally from the base, wherein the first and second walls are configured to engage said tensioning member, whereby said tensioning member pivots with said arm relative to said body.

6. The device of claim 1, wherein said arm further comprises an end pivotally coupled to said body at a location offset from a longitudinal centerline of said body.

7. A device for rotating a tubular comprising:

a body with a drive assembly coupled thereto;

an arm pivotally coupled to said body;

a tensioning member pivotally coupled to said body;

wherein said arm comprises a base, a first wall extending substantially normally from the base, and a second wall extending substantially normally from the base, wherein the first and second walls are configured to engage said tensioning member, whereby said tensioning member pivots with said arm relative to said body;

a flexible belt coupled between said tensioning member and the drive assembly; and an actuator coupled between said body and said tensioning member, said actuator operable to displace said tensioning member between a first position and a second position;

wherein, when said tensioning member is displaced toward the second position, said tensioning member increases a tension load to said flexible belt; and wherein, when said tensioning member is displaced toward the first position, said tensioning member reduces the tension load to said flexible belt;

wherein said body comprises a slot formed therein, the slot having a forward end and a rearward end; and wherein said actuator is coupled to said body by a pin slideably disposed within the slot.

8. The device of claim 7, wherein said actuator is operable to slide the pin within the slot toward the forward end, whereby said tensioning member is displaced toward the second position, and toward the rearward end, whereby said tensioning member is displaced toward the first position.

9. The device of claim 7, wherein the slot in the body comprises:

a first portion that is substantially linear and parallel to the longitudinal centerline, the first portion including the forward end of the body slot;

a second portion angularly offset relative to the longitudinal centerline and including the rearward end of the body slot; and a third portion extending therebetween.

10. The device of claim 7, wherein the pin is slideably disposed within a slot formed in said arm, the slot in the arm having a forward end and a rearward end, wherein, when the pin slides within the slot in the arm toward the forward end, said arm pivots toward a longitudinal centerline of said body, and when the pin slides within the slot in the arm toward the rearward end, said arm pivots away from the longitudinal centerline.

11. The device of claim 10, where said actuator comprises a rod coupled to the pin, the rod extendable and retractable to slide the rod within the body slot and the arm slot.

12. A device for rotating a tubular comprising:

a body having a longitudinal centerline;

a first arm and a second arm each pivotally coupled to said body, said first and second arms disposed on opposing sides of the longitudinal centerline;

a first actuator coupled to said body, said first actuator operable to pivot said first arm relative to said body;

a second actuator coupled to said body, said second actuator operable to pivot said second arm relative to said body; and a linkage system coupled between said first arm and said second arm, said linkage system configured such that movement of said second arm mirrors of movement of said first arm and movement of said first arm mirrors movement of said second arm;

wherein said linkage system comprises two substantially identical links, one link mirrored relative to the other link about the longitudinal centerline;

a shaft slideably disposed within a slot formed in the body and wherein a first end of each link is pivotally coupled to the shaft.

13. The device of claim 12, wherein a second end of one link is pivotally coupled to said first actuator and a second end of the other link is pivotally coupled to said second actuator.

14. The device of claim 12, wherein each link is rigid.

15. The device of claim 12, wherein each link comprises a straight portion connected to a curved portion.

* * * * *